US005232038A

United States Patent [19]

Buxbaum

[11] Patent Number: 5,232,038

[45] **Date of Patent: * Aug. 3, 1993**

[54] DRIVES FOR WIND-UP BLINDS

[76] Inventor: Gary Buxbaum, 15 Clent Rd. - Apt. 3E, Great Neck, N.Y. 11021

[ * ] Notice: The portion of the term of this patent subsequent to Jun. 12, 2007 has been disclaimed.

[21] Appl. No.: 534,251

[22] Filed: Jun. 7, 1990

Related U.S. Application Data

[63] Continuation-in-part of Ser. No. 374,757, Jul. 3, 1989, Pat. No. 4,932,456.

[51] Int. Cl.[5] ..... A47H 1/00

[52] U.S. Cl. ..... 160/308; 160/304.1; 160/321

[58] Field of Search ..... 160/300, 321, 291, 297, 160/301, 304.1, 307, 308, 319

[56] References Cited

U.S. PATENT DOCUMENTS

| | | | |
|---|---|---|---|
| 197,234 | 11/1877 | Wagner | 160/308 X |
| 2,564,831 | 8/1951 | Butkus | 160/321 X |
| 2,577,046 | 12/1951 | Svirsky | 160/321 |
| 2,773,547 | 12/1956 | Voss | 160/301 |
| 2,894,578 | 7/1959 | Caesar et al. | 160/308 |
| 3,854,517 | 12/1974 | Nakamura | 160/321 X |
| 4,139,044 | 7/1977 | Brolin | 160/321 |
| 4,475,580 | 10/1984 | Hennequin | 160/308 |
| 4,476,910 | 10/1984 | Saito | 160/291 |
| 4,779,662 | 10/1988 | Wilk | 160/321 |
| 4,932,456 | 6/1990 | Buxbaum | 160/300 X |

FOREIGN PATENT DOCUMENTS

| | | | |
|---|---|---|---|
| 3522121A | 10/1986 | Fed. Rep. of Germany | 160/297 |

*Primary Examiner*—David M. Purol

[57] ABSTRACT

The disclosed drive uses a ball chain and sprocket for adjusting a wind-up blind and a locking device activated by the ball chain into cooperation with the sprocket for blocking the sprocket and locking the drive, avoiding any large stress in the chain.

17 Claims, 2 Drawing Sheets

DRIVES FOR WIND-UP BLINDS

This is a continuation-in-part of my pending application Ser. No. 07/374,757 filed Jul. 3, 1989, now U.S. Pat. No. 4,932,456, issued Jun. 12, 1990.

The present invention relates to drives for a wind-up blind, e.g. a window blind.

A wind-up blind on a core is adjusted by means of an operating mechanism secured to one end of the core. Commonly, a sprocket is fixed to the core, to be operated by a ball chain. The weight of the blind or a coil spring in the core or both the blind's weight and the spring provide a bias tending to unwind the blind. The chain extends partway around the sprocket and has two lengths that hang from opposite sides of the sprocket. One chain length is idle; the other length is held taut both in winding more of the blind or the core and in allowing the blind to become adjustably unwound due to its weight or spring bias.

When a desired adjustment is established, the taut chain length is shifted into interlocking engagement with a locking element that fits between balls of the chain in a common drive for blinds. The blind is allowed to unwind a bit as it engages the locking element, and it is abruptly arrested. A sudden stress develops in the ball chain which may break; and a broken chain lets the blind drop suddenly with potentially damaging effect.

My '757 patent application mentioned above discloses novel mechanisms for avoiding that sudden stress in the chain. The present application is drawn to improvements and it provides a more detailed exposition of the kind of drives for wind-up blinds in my '757 application.

In the present and earlier novel drives, the taut operating length of chain is shifted into position controlling a locking device; partial relaxation of tension in the chain results in the locking device becoming coupled to the sprocket, and the locking device is carried by the sprocket as it turns in the unwinding direction until the locking device is blocked. The sprocket is prevented from turning in the unwinding direction; no intense tensioning stress develops in the chain as the blind is arrested.

In the present drive, also in one of the drives in my '757 application, an arcuate guide curves around the sprocket; a pin on the locking device follows the guide when the locking device has become coupled to the sprocket. Before the pin reaches that arcuate guide, it is contained in a radial slot, being a relief that allows the locking device to be uncoupled from the sprocket so that the blind can be adjusted by operating the chain.

In the improved drive detailed below, manipulation of the taut length of the operating chain causes the locking device to be shifted into a stable attitude in relation to the sprocket. In that attitude, the locking device remains securely coupled to the sprocket when, and so long as, the pin is received in its arcuate guide. This stability may result from the provision of two knobs on the locking device that cooperate with arcuately spaced-apart pockets of the sprocket or from an arcuate range of the locking device that is cooperable with the sprocket. In the presently preferred embodiment, the stable attitude of the locking device in relation to the sprocket may be ascribed to either or both of those factors. The thus stabilized coupling of the locking device to the sprocket is maintained by the pin when confined by the arcuate guide. This coupling does not depend on sustained cooperation of the taut length of chain with the locking device.

The drive detailed below and one of the drives in the '757 application are reversible so that they are adapted for use with a blind whose wind-up direction in relation to the sprocket may be reversed, as explained below.

The invention will be better appreciated from the following detailed description of the presently preferred embodiment which is shown in the drawings.

IN THE DRAWINGS

Figure 2:
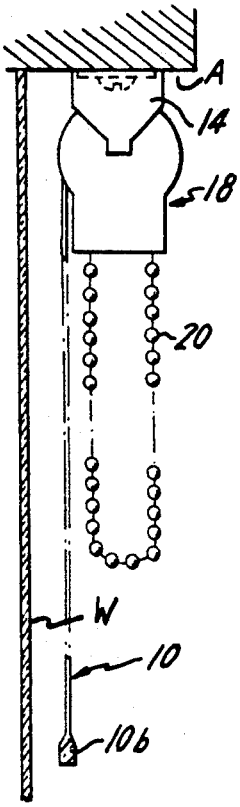
FIG. 2 is a side elevation of the structure of FIG. 1, partly in cross-section at the plane 2—2 of FIG. 1.

Referring to the drawings, window W is illustrated diagrammatically in a window opening A of a wall. A portion 10*a* of blind 10 is wound to some extent on a core 12 carried by brackets 14 and 16. A bar 10*b* across the bottom margin of the blind provides weight that keeps the blind taut.

Mechanism 18 is operated by a ball chain 20, either to turn core 12 for winding the blind on core 12 or for controlling the blind as it is unwound by weight 10*b*. Mechanism 18 includes a stationary support member 22 including a vertical panel 24, a rim 26, and stub shaft 28. Rim 26 projects from panel 24; the rim extends approximately three quarters of a circle around the axis of stub shaft 28 and includes straight vertical segments 26*a* that also project from panel 24.

Figure 4:
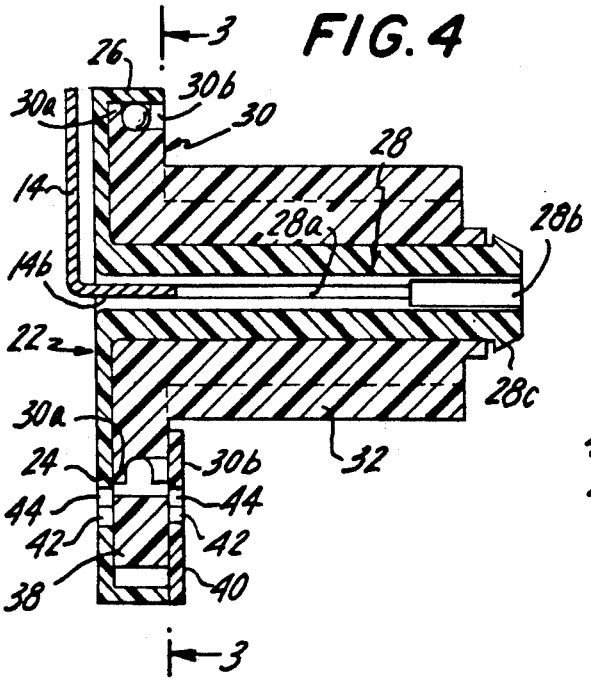
FIG. 4 is a cross-section of the drive mechanism of FIG. 3 at the plane 4—4 of FIG. 3.

Bracket 14 includes a horizontal tang 14*b* (FIG. 4) that extends into the grooved passage 28*a* in stub shaft 28. This bracket with its tang 14*b* fixes support member 22 in the position or attitude represented in FIG. 3.

Mechanism 18 includes a sprocket 30 having a horizontal projecting bushing 32 which is rotatable on stub shaft 28. Parallel splines 32*a* on bushing 32 project outward; these splines mate with grooves (not shown) in core 12. The stub shaft 28 has a slot 28*b*, forming a bifurcated resilient end portion of the stub shaft. Detents 28*c* on the bifurcated stub shaft 28 abut the right-hand end of bushing 32, holding the sprocket releasably in its position against vertical support panel 24.

Ball chain 20 in the form of an endless loop depends from mechanism 18. Ball chain 20 extends roughly three-fourths of the way around sprocket 30, leaving the lower one-fourth of the sprocket's pockets as a free range. Those pockets are defined by side walls that separate each pocket from the next; and as a design expedient to facilitate molding of the sprocket, the pockets include end walls 30*a* and 30*b* (FIGS. 3 and 4) that alternate all the way around the sprocket.

A locking device 38 is disposed below sprocket 30, in its free range. (The locking device is stippled in FIGS. 3, 5 and 6 to make that part more recognizable.) A wall 40 has upstanding flanges 40*a* that embrace and are secured to rim portions 26*a*. A variety of interlocking formations on rim portions 26*a* and flanges 40*a* may be used for securing wall 40 to member 22.

Locking device 38 has aligned pins 42 that project from opposite sides of the locking member. These pins are received in identical mutually aligned slots in panel 24 and wall 40. Each of these slots includes an arcuate slot portion 44 (see especially FIG. 6) and a vertical slot portion 46 that branches downward from its respective arcuate slot portion 44, midway between the ends of slot portion 44.

At each end, locking device 38 has a knob 38*a* that is shaped for readily entering the pockets of sprocket 30. An arcuate top surface 38*b* (FIG. 3) is complementary to the cylindrical outer surface portions of sprocket 30 that is breached by the cavities which receive the balls of the ball chain. Locking device 38 has two pockets 38*c* in each of its oppositely slanting end surfaces for receiving the balls of the ball chain.

Figure 3:
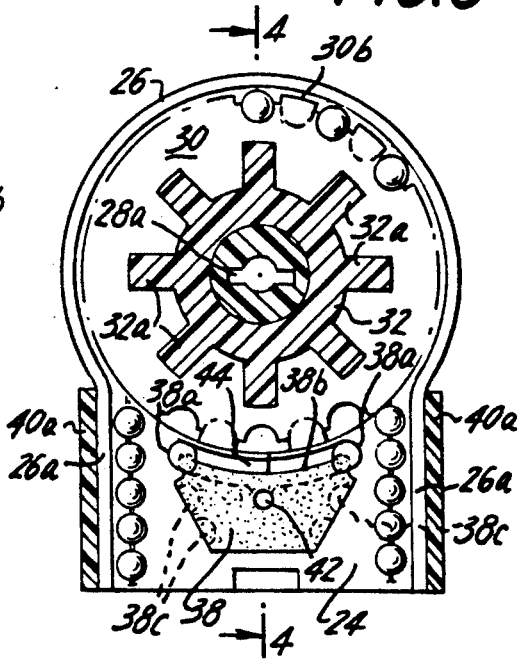
FIG. 3 is a cross-section of a novel drive mechanism for operating a wind-up blind, as an embodiment of the invention, shown partly in cross-section at the vertical plane 3—3 of FIG. 4.

FIG. 3 shows locking device 38 in its idle position, when the ball chain operates the blind for winding it or controlling its weight-induced unwinding.

Figure 1:
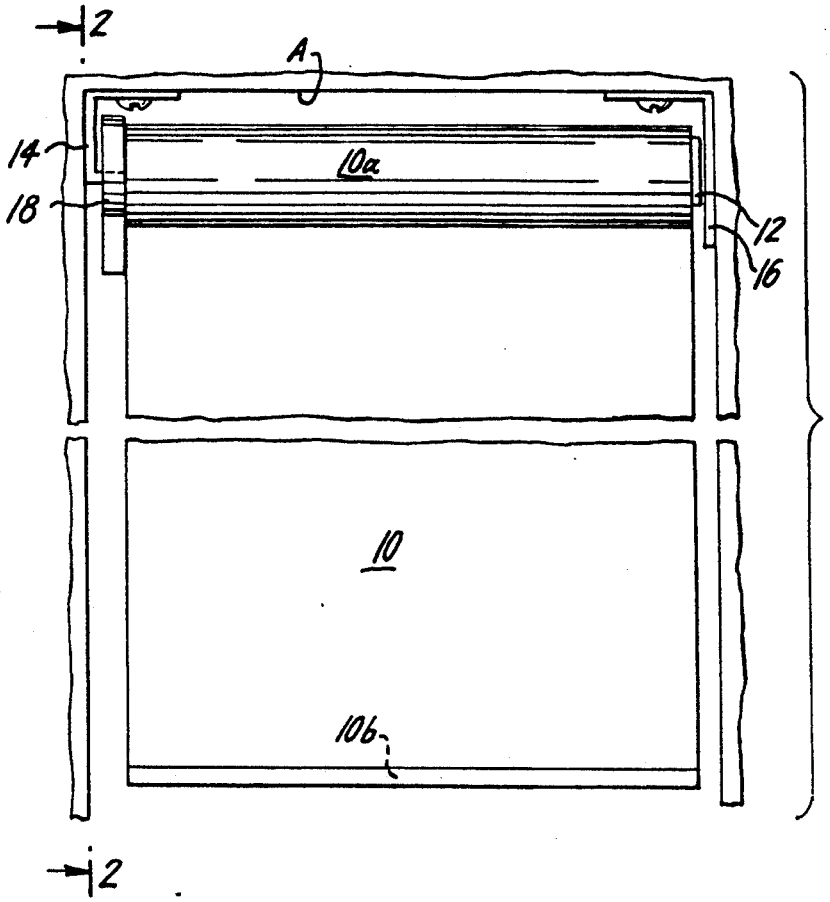
FIG. 1 is a front view of a window in a wall opening and a wind-up blind suspended in the opening, drawn to greatly reduced scale.
Figure 5:
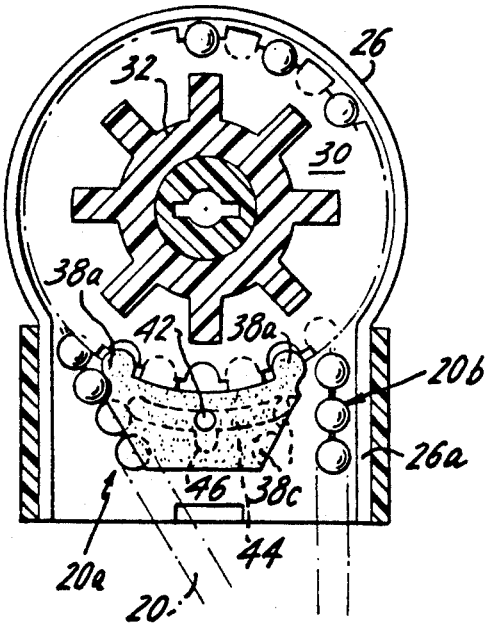
FIGS. 5 and 6 are views like FIG. 3 showing the mechanism in progressive stages of becoming locked for holding a blind in a desired adjustment.
Figure 6:
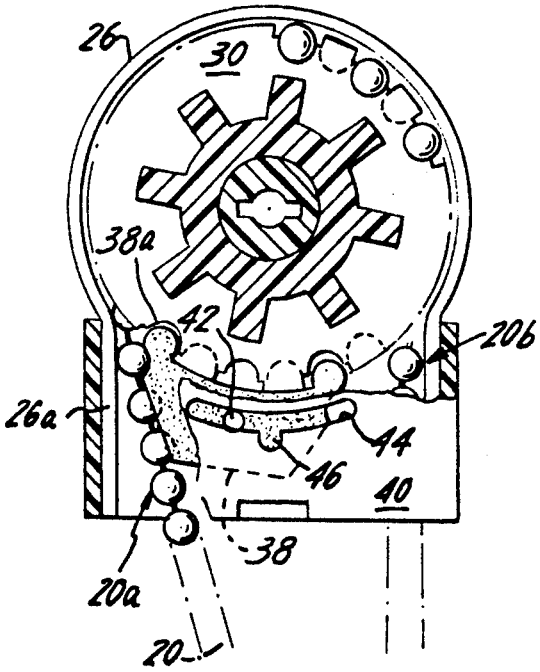

Locking device 38 is actuated by ball chain 20 when the blind is to be locked in any adjustment. The manner of operation for that purpose is shown in FIGS. 5 and 6 when mechanism 18 is mounted in the relationship of FIGS. 1 and 2. As will be seen, the same mechanism is effective without change for locking a blind in adjustment when the direction of winding/unwinding is reversed or when the mechanism is mounted at the opposite end of the core's axis and the direction of winding-/unwinding is the same as is represented in FIGS. 1 and 2. Length 20*b* of the chain hangs idly. Pin 42 is centered between the opposite sides of the locking device (FIG. 3). Those sides converge along lines that intersect below pin 42, i.e., below oppositely extending pins 42. Knobs 38*a* of the locking device are spaced apart in accordance with the spacing of the pockets in the sprocket.

To activate locking device 38, taut length 20*a* of the ball chain is first shifted against a slant side of device 38. As the chain bears against locking device 38, balls of the chain become seated in cavities 38*c* of the locking device. Then length 20*a* of the chain is allowed to shift upward. Locking device 38 first reaches the position shown in FIG. 5 and it finally reaches the locked condition shown in FIG. 6. In greater detail, this operation is as follows.

Pressure toward the right (FIG. 5) is applied by the ball chain to locking member 38. At first, that pressure is resisted by pins 42 bearing against the right-hand edges of slot portions 46 in walls 24 and 40. Locking device 38 is first raised toward sprocket 30 from its position in FIG. 3, and oppositely projecting pins 42 are lifted into alignment with arcuate slot portions 44. As the pins 42 leave slot portions 46, knobs 38*a* enter respective pockets of the sprocket. Both ends of arcuate locking surface 38*b* (FIG. 3) have shifted very close to sprocket 30, so that the locking device cannot tilt in relation to the sprocket. Locking device 38 is now in a stable attitude relative to sprocket 30, and it is coupled to the sprocket by knobs 38*a*, to be carried with the sprocket.

In this condition of the parts, relaxation of the Tension in chain length 20*a* allows the sprocket to turn clockwise, carrying pins 42 into arcuate slot portions 44. The lower edges of slot portions 44 constitute guides that confine the locking device in its stable attitude coupled to the sprocket. This coupled relationship does not depend in any way on pressure of the chain against the locking device.

With the mechanism in the condition of FIG. 5, if chain portion 20*a* were displaced downward, the locking device would be restored to its idle position (FIG. 3). However, allowing chain portion 20*a* to continue moving upward (in the unwinding direction of the sprocket) causes the sprocket to shift device 38 until left-hand knob 30*a* bears against a ball of the chain which, in turn, bears against rim 26*a* (FIG. 6).

The mechanism is readily released by pulling the chain slightly in the blind-winding direction. Locking device 38 is carried to the right (FIG. 6) until pins 42 drop into slots 46.

Locking of the mechanism does not depend on knob 38*a* bearing against a ball as shown in FIG. 1. Notably, if wall 24 were to have a stop projecting into the leftward path of locking device 38, the locking device 38 would be blocked in the same way. Moreover, slots 44 can be shortened so that pins 42 reach the ends of the slots and block the locking device, arresting the sprocket. As a further variant, essentially the same operation of the locking device would be realized if only one knob were used, centered over pin 42, relying on one side of locking device or the other to be blocked by engaging the ball chain or by interposing a fixed stop to arrest the locking device.

The mechanism as shown is symmetrical, in that portion 20*b* of the chain is operative to lock the sprocket against unwinding rotation if the direction of winding were reversed, or (more usually) if the mechanism shown were to be mounted at the opposite end of core 12 with the same winding direction as that in FIGS. 1 and 2.

The illustrative embodiment of the invention described above and shown in the drawing is presently preferred. However, a variety of modification may readily be made by those skilled in the art. Consequently, the invention should be construed broadly in accordance with its true spirit and scope.

I claim:

1. A drive for a blind that is to be adjustably wound on a core, the blind being biased by its weight or otherwise to unwind, said drive including:

a rotor to be secured to the core;

a support for said rotor;

a locking device ordinarily not coupled to the rotor but being optionally operable into coupled relationship to said rotor such that the locking device is forced to move with the rotor during ongoing turning of said rotor in the blind-unwinding direction;

an operating chain for said rotor, said chain being optionally movable into engagement with said locking device for then shifting the locking device into said coupled relationship to the rotor, said coupled relationship of the locking device to the rotor being independent of said chain;

means for blocking the locking device after it has been carried to some extent in coupled relationship to the rotor, thereby arresting the drive; and said drive having constraining means independent of said chain for maintaining said locking device coupled to said rotor during said ongoing turning of the rotor.

2. A drive as in claim 1, wherein said rotor has an encircling series of rotor formations and wherein said locking device has at least one locking-device formation in interengagement with one of said rotor formations of said series when said coupled relationship is in effect.

3. A drive as in claim 1, wherein said rotor has an encircling series of rotor formations and wherein said locking device has multiple locking-device formations that are spaced apart for concurrent interengagement with respective arcuately spaced-apart rotor formations of said series for providing said coupled relationship.

4. A drive as in claim 2, wherein said constraining means includes means for retaining said locking device in a prescribed attitude relative to said rotor during said ongoing turning of the rotor, for thereby assuring stability of said interengagement of said formations of the locking device and the rotor.

5. A drive as in claim 4, wherein said attitude retaining means includes a portion of said locking device that bears against a portion of said rotor arcuately spaced from at least one said locking-device formation that is in interengagement with a rotor formation of said series.

6. A drive as in claim 1, wherein said constraining means includes cooperating elements comprising a guide curved about the rotor's axis and a pin that coacts with the guide, one of said elements being part of said support of the rotor and the other of said elements being part of said locking device.

7. A drive as in claim 6, wherein said guide has a relief that allows said pin to shift out of and into coaction with the guide for alternately allowing chain-controlled operation of said rotor and for locking the drive.

8. A drive as in claim 1 adapted for operation both when said rotor turns in one direction or the reverse as the blind unwinds, wherein the locking device has essentially opposite side portions selectively engageable by the chain for shifting the locking device into said coupled relationship to the rotor.

9. A drive as in claim 8, wherein said constraining means includes cooperating elements comprising a guide curved about the rotor's axis and a pin that coacts with the guide, one of said elements being part of said support of the rotor and the other of said elements being part of said locking device, and wherein said guide is divided into two segments and a relief is provided between said segments that allows the pin to shift out of and into coaction with the guide, the pin being arranged to coact with one of said segments or the other in accordance with the direction of rotation of the rotor as the blind unwinds.

10. A drive as in claim 2, wherein said chain is a ball chain, wherein said ball chain coacts with an arcuate range of said encircling series of rotor formations, leaving a free range of said rotor formations unoccupied by the chain, and wherein said locking device is disposed opposite to said free range for coaction of said locking-device formation or formations with formations of the rotor in said free range.

11. A drive for a blind that is to be adjustably wound on a core, said drive including: a sprocket adapted to be secured to the core, said sprocket on axis and having a series of pockets for receiving balls of a ball chain; a support for the sprocket; a ball chain having balls thereof received in a succession of said pockets, a free range of the pockets of the sprocket being unoccupied by such balls; a locking device opposite to said sprocket in said free range, said locking device being uncoupled from said sprocket during operation of the drive for adjusting the extent of the blind that is wound on the core; said locking device having a knob receivable in a pocket of the sprocket unoccupied by the ball chain, said locking device in a first operating phase being movable by the ball chain for shifting said knob into a pocket of the sprocket for thereby forming a coupled relationship of the locking device to the sprocket, the locking device in the ensuing phase of operation of the drive in the blind-unwinding direction being shifted by the sprocket into blocked engagement with a portion of said drive for thereby arresting the drive; said drive having means effective during said ensuing phase of operation of the drive and independent of said ball chain for assuring maintenance of said coupled relationship of said locking device to said sprocket.

12. A drive as in claim 11, wherein said means for assuring maintenance of said coupled relationship of the locking device to the sprocket includes means for maintaining a fixed attitude of the locking device in relationship to the sprocket during said ensuing phase of operation.

13. A drive as in claim 11, wherein said locking device has a second knob receivable in a second pocket of said series of pockets, said second pocket being arcuately spaced from the first-mentioned pocket for concurrently receiving said knobs.

14. A drive as in claim 12, wherein said means for assuring maintenance of said coupled relationship includes cooperating elements comprising a guide curved about the sprocket's rotor's axis and a pin that coacts with the guide, one of said elements being part of said support of the sprocket and the other of said elements being part of said locking device.

15. A drive as in claim 11 adapted for reversible operation both when said sprocket turns in one direction or the reverse as the blind unwinds, wherein essentially opposite sides of the locking device are engageable by the chain for shifting the locking device into said coupled relationship with the sprocket, and wherein said means for assuring maintenance of said coupled relationship includes cooperating elements comprising a guide curved about the sprocket's axis and a pin that coacts with the guide, one of said elements being part of said support of the sprocket and the other of said elements being part of said locking device, and wherein said guide is divided into two segments and a relief is provided between said segments that allows the pin to shift out of and into coaction with the guide for alternately allowing chain-controlled operation of said sprocket and locking of the drive, the pin being arranged to coact with one of said segments or the other in accordance with the direction of rotation of the sprocket as the blind unwinds.

16. A drive for a blind to be wound adjustably on a core wherein a bias due to the weight of the blind or otherwise tends to turn the core in the blind-unwinding direction, said drive including a sprocket having an encircling series of pockets, a support for said sprocket, an endless ball chain having balls received in a range of said pockets while leaving a free range of said pockets unoccupied, a locking device disposed opposite to said free range, said locking device having a pair of spaced-apart knobs receivable concurrently in a pair of said pockets that are arcuately spaced apart, said locking device having a pin located along a radius of the sprocket that is approximately centered between said knobs, said locking device having opposite margins flanking said pin and converging along lines that intersect at a point farther from said axis than said pin and said locking device having at least ball-receiving cavity in each said margin, said support having a guide for said pin including an arcuate guide portion curved about the sprocket's axis and a radial slot intersecting said arcuate guide portion and dividing said arcuate guide portion into two arcuate guide segments, said guide and said sprocket and said locking device being proportioned so that said knobs are held in pockets of the sprocket when the pin is in engagement with said arcuate guide portion, said chain being operable to adjust the extent of the blind that is wound on the core while said knobs are disengaged from the sprocket and said locking device, accordingly, is uncoupled from the sprocket, said pin being located in said radial slot before and until said knobs are received in pockets of the sprocket, a chosen length of the chain which is in tension due to the blind-unwinding bias being engageable with one of the margins of said locking device and being effective in an initial phase of operation to cause the locking device to shift so that said knobs are received in a pair of said pockets and so that the pin leaves said radial slot and becomes aligned with said arcuate guide portion, said knobs then acting to couple the locking device to the sprocket for motion of the locking device with the sprocket as it turns during an operating phase ensuing said initial phase, said pin moving along said arcuate guide portion and holding the locking device coupled to the sprocket during said ensuing operating phase, said drive having means in the path of said locking device as its pin moves along said arcuate guide portion for blocking said locking device and arresting said drive.

17. A drive for a blind that is to be adjustably wound on a core, said drive including: a sprocket adapted to be secured to the core, said sprocket having a series of pockets for receiving balls of a ball chain; a support for the sprocket; a ball chain having balls thereof received in a succession of said pockets, a free range of the pockets of the sprocket being unoccupied by such balls; a locking device opposite to said sprocket in said free range, said locking device being uncoupled from said sprocket during operation of the drive for adjusting the extent of the blind that is wound on the core; said locking device having multiple knobs spaced apart so that such knobs are cooperable concurrently with respective pockets of the sprocket unoccupied by the ball chain, said locking device in a first operating phase being movable by the ball chain for shifting said knobs into respective pockets of the sprocket for thereby forming a coupled relationship of the locking device to the sprocket, the locking device in the ensuing phase of operation of the drive in the blind-unwinding direction being shifted by the sprocket into blocked engagement with a portion of said drive for thereby arresting the drive.

* * * * *